US007578097B2

(12) United States Patent
Dondlinger et al.

(10) Patent No.: US 7,578,097 B2
(45) Date of Patent: Aug. 25, 2009

(54) INFLATABLE DOOR SEAL

(75) Inventors: Jason Dondlinger, Bellevue, IA (US); Tom Jansen, Dubuque, IA (US); Frank Heim, Platteville, WI (US); Kevin J. Gebke, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 217 days.

(21) Appl. No.: 10/667,259

(22) Filed: Sep. 19, 2003

(65) Prior Publication Data

US 2005/0060937 A1 Mar. 24, 2005

(51) Int. Cl.
*E06B 7/18* (2006.01)

(52) U.S. Cl. ..... 49/477.1; 49/118

(58) Field of Classification Search ..... 49/116, 49/118, 360, 477.1
See application file for complete search history.

(56) References Cited

U.S. PATENT DOCUMENTS

| | | | | |
|---|---|---|---|---|
| 2,420,240 | A | 5/1947 | Haggerty | |
| 3,303,615 | A | 2/1967 | O'Neal | |
| 3,341,974 | A | 9/1967 | Ganzinotti | |
| 3,359,687 | A | 12/1967 | Wallace | |
| 3,491,825 | A * | 1/1970 | Matson et al. | 164/228 |
| 3,518,355 | A * | 6/1970 | Luce | 174/35 MS |
| 3,714,745 | A | 2/1973 | O'Neal | |
| 3,745,707 | A | 7/1973 | Herr | |
| 3,809,144 | A | 5/1974 | Garufo | |
| 3,816,867 | A | 6/1974 | Shirzad et al. | |
| 3,840,266 | A | 10/1974 | Carlson | |
| 3,939,614 | A | 2/1976 | Frommelt et al. | |
| 3,984,942 | A | 10/1976 | Schroth | |
| 3,994,103 | A | 11/1976 | Ouellet | |
| 4,020,607 | A | 5/1977 | Bjervig | |
| 4,045,925 | A | 9/1977 | O'Neal | |
| 4,150,509 | A * | 4/1979 | Knap | 49/123 |
| 4,177,353 | A * | 12/1979 | McCormack | 174/374 |
| 4,238,910 | A | 12/1980 | O'Neal | |
| 4,262,458 | A | 4/1981 | O'Neal | |

(Continued)

FOREIGN PATENT DOCUMENTS

CH 600 117 12/1977

(Continued)

OTHER PUBLICATIONS

Presray Pauling Trade Journal Advertisements; "Pneuma-Seal Inflatables"; seen circa Oct. 2003; 1 page.

(Continued)

*Primary Examiner*—Jerry Redman
(74) *Attorney, Agent, or Firm*—Hanley, Flight & Zimmerman, LLC

(57) ABSTRACT

A door for a cold storage locker or other applications includes an inflatable or fluid-filled seal system. The seal system comprises a network of pliable tubular seals that expand as air or another fluid is forced air through the seals. Expansion of the seals provides a more positive seal. To inhibit frost from accumulating near the seals, the seals are kept relatively warm by continuously circulating fluid through the seals regardless of whether the door is open or closed. In some cases, the fluid within the seals is heated.

30 Claims, 6 Drawing Sheets

U.S. PATENT DOCUMENTS

| | | | | | |
|---|---|---|---|---|---|
| 4,293,969 | A | | 10/1981 | Frommelt | |
| 4,322,923 | A | | 4/1982 | O'Neal | |
| 4,371,175 | A | * | 2/1983 | Van Dyk, Jr. | 174/357 |
| 4,372,084 | A | * | 2/1983 | Janke | 49/477.1 |
| 4,579,192 | A | * | 4/1986 | Mueller | 277/312 |
| 4,671,029 | A | | 6/1987 | Bennett et al. | |
| 4,706,413 | A | | 11/1987 | James | |
| 4,750,299 | A | | 6/1988 | Frommelt et al. | |
| 4,813,184 | A | * | 3/1989 | Weimar | 49/477.1 |
| 4,821,468 | A | | 4/1989 | Moore | |
| 5,007,211 | A | | 4/1991 | Ouellet | |
| 5,220,696 | A | | 6/1993 | Dannenberg et al. | |
| 5,452,550 | A | * | 9/1995 | Vanesky et al. | 52/173.1 |
| 5,553,424 | A | | 9/1996 | Brockman et al. | |
| 6,098,992 | A | * | 8/2000 | Long et al. | 277/637 |
| 6,922,945 | B2 | * | 8/2005 | Dron | 49/477.1 |

FOREIGN PATENT DOCUMENTS

| | | | |
|---|---|---|---|
| GB | 2220434 | A * | 1/1990 |

OTHER PUBLICATIONS

"Presray Pneuma-Seal" Product Line Brochure, The Presray Corporation; copyright 1998, 16 pages.

"Sealmaster Inflatable Seals" Product Brochure; SealMaster Corporation; electronic version of document created Mar. 5, 2002—publication date unknown—first seen by applicant circa Jan. 1, 2004; 8 pages.

*International Search Report*, Jan. 24, 2005, 3 sheets.

*Written Opinion of the International Searching Authority*, Jan. 24, 2005, 5 sheets.

Patent Cooperation Treaty, "International Preliminary Report on Patentability" PCT/US04/29997 (4 pages).

* cited by examiner

INFLATABLE DOOR SEAL

BACKGROUND OF THE INVENTION

1. Field of the Invention

The subject invention generally pertains to a system and method for sealing doors and more specifically to an inflatable or fluid-filled seal for a door.

2. Description of Related Art

So-called horizontally sliding doors (which actually may slide or roll) usually include one or more door panels that are suspended by carriages that travel along an overhead track. To open and close the door, the carriages move the door panels in a generally horizontal direction in front of the doorway. The movement of the panels can be powered or manually operated. Depending on the width of the doorway and the space along either side of it, a sliding door can assume a variety of configurations.

For a relatively narrow doorway with adequate space alongside to receive an opening door panel, a single panel may be sufficient to cover the doorway. Wider doorways with limited side space may require a bi-parting sliding door. Bi-parting doors include at least two panels, each moving in opposite directions from either side of the doorway and meeting at the center of the doorway upon closing. For even wider doorways or those with even less side space, multi-panel sliding doors can be used. Multi-panel doors have a series of door panels that overlay each other at one side of the doorway when the door is open. When the door closes, each panel slides out from behind the others to cover the span of the doorway. Applying such an arrangement to both sides of the doorway provides a bi-parting door with multiple panels on each side.

Sliding doors are often used to provide access to cold-storage lockers, which are rooms that provide large-scale refrigerated storage for the food industry. Doorways into such a room are often rather wide to allow forklift trucks to move large quantities of products in and out of the room. When closing off a refrigerated room, sliding doors are often preferred over other types of doors because sliding panels are generally easy to make thick with insulation to reduce the cooling load on the room. Refrigerated rooms, however, may have other types of doors such as swinging doors, roll-up doors, bi-fold doors, and overhead-storing doors.

Regardless of the type of door applied to a cold-storage locker, ineffectively sealing the edges around the door panels can create cooling losses and promote frost buildup in certain areas of the door. A particularly narrow seal, for instance, may be unable to span relatively wide air gaps and may provide insufficient thermal insulation. Air gaps can allow warm outside air to enter the refrigerated room where the warm air can condense and freeze on inner surfaces of the door and the room. Even without air gaps, seals with insufficient thermal insulation may conduct heat from exterior surfaces to the interior of the refrigerated room. This lowers the temperature of those exterior surfaces and promotes condensation and frost buildup.

Consequently, a need exists for a more effective system and method for the sealing of cold-storage lockers, wherein the seal can span rather wide air gaps and inhibit the buildup of frost.

SUMMARY OF THE INVENTION

In some embodiments, a door includes an inflatable seal through which air is conveyed to help warm the seal.

In some embodiments, air is conveyed through a door seal regardless of whether the door is open or closed.

In some embodiments, a flexible hose connects a stationary blower to a movable seal.

In some embodiments, a blower that inflates the seal moves with the door panel.

In some embodiments, the air entering the seal is warmer than the air exiting the seal, whereby the air releases heat to the seal.

In some embodiments, an inflatable or fluid-fillable seal with novel and advantageous properties is disclosed.

Accordingly, the presently disclosed invention provides a sealing system and method according at least to the subject matter of the independent claims. Some of the embodiments of the invention are defined in the respective dependent claims. It will be apparent to those skilled in the art that the previously mentioned features and those explained below pertain to the invention not only in the given combinations, but in other combinations or individually.

DESCRIPTION OF THE PREFERRED EMBODIMENTS

Figure 1:
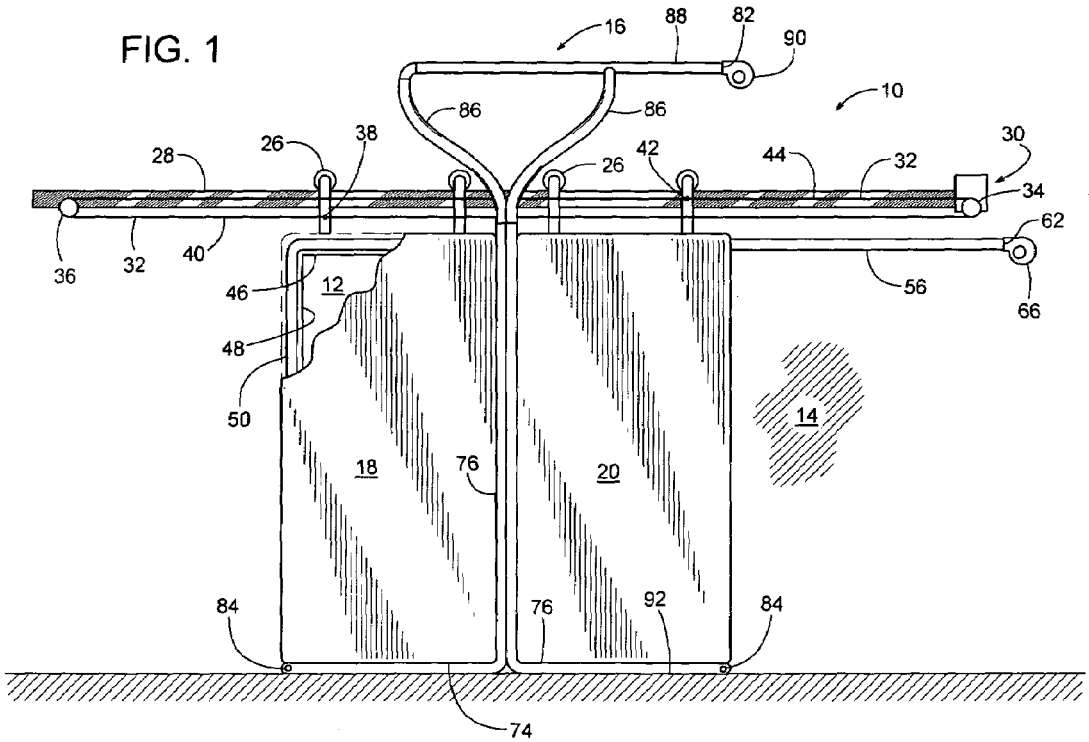
FIG. 1 is a front view of a closed door with a portion of a door panel cutaway to show an inflatable seal system.
Figure 2:
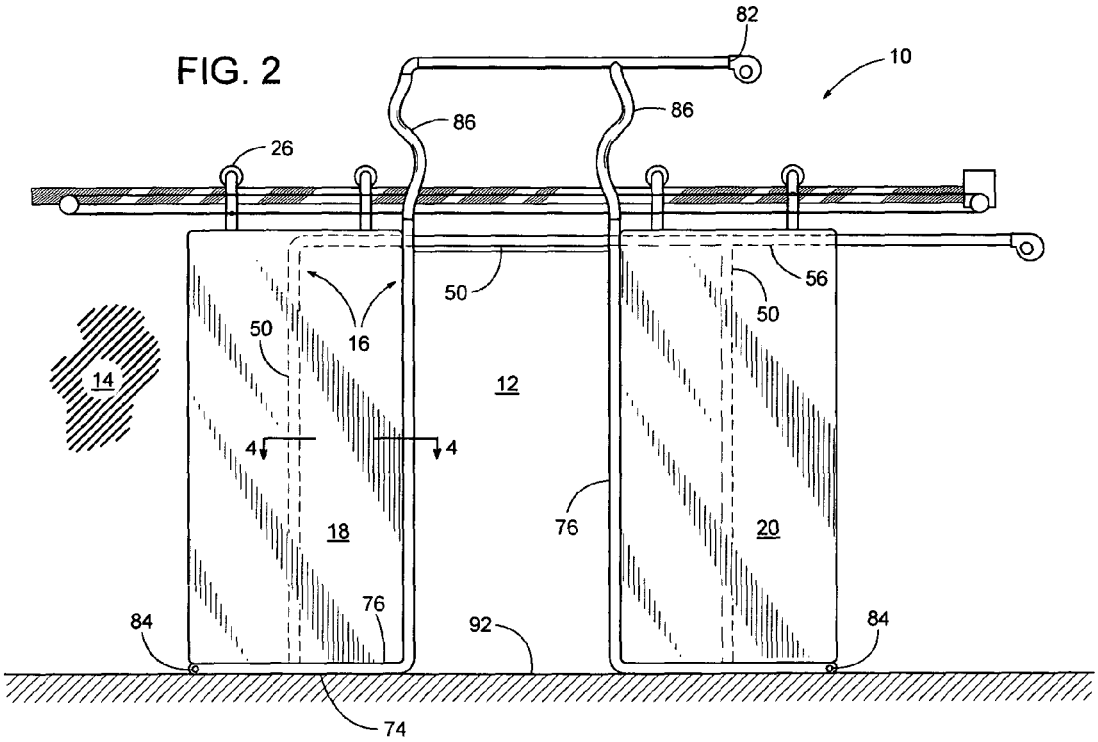
FIG. 2 is a front view of the door of FIG. 1 but showing the door partially open.
Figure 3:
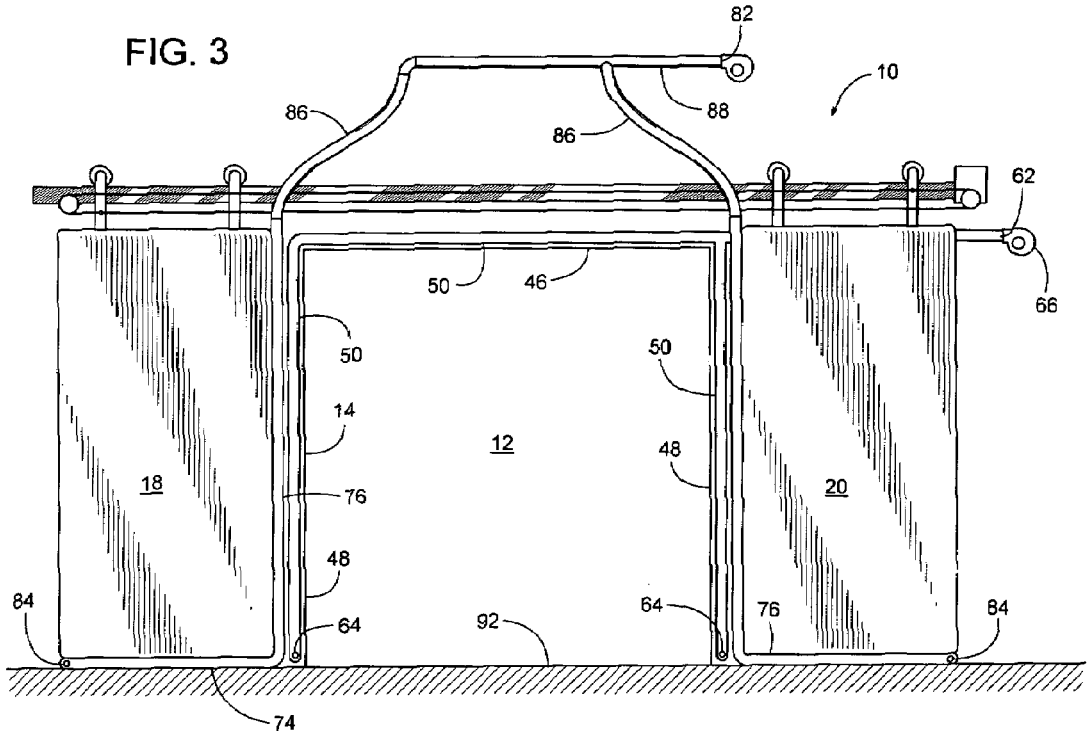
FIG. 3 is a front view of the door of FIG. 1 but showing the door fully open.
Figure 4:
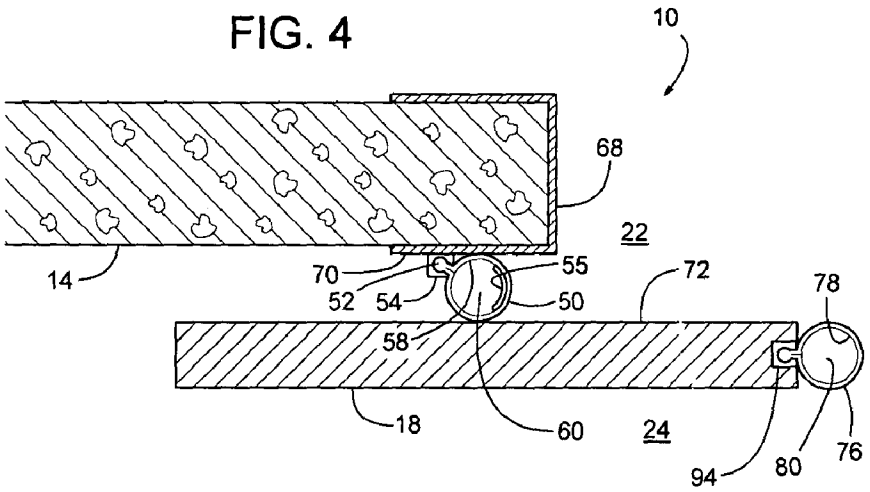
FIG. 4 is a cross-sectional view taken along line 4-4 of FIG. 2.

FIGS. 1-4 show a door 10 having at least one door panel that can pivot, translate or otherwise move across a doorway 12 of a wall 14. Door 10 can help separate one area within a building from another. An inflatable sealing system 16 helps prevent leakage between the two areas when door 10 is closed and provides other benefits that will be explained later. Although the type of door and its surroundings may vary (e.g., the invention may be applied to any size and type of door), an exemplary embodiment of the invention will be described with reference to door 10 having two translating door panels 18 and 20 that help close off a cold storage locker. So, door 10 helps separate a first area 22 of colder air from a second area 24 of warmer air, as shown in FIG. 4. In some cases, however, area 22 is the warmer area, and area 24 is the colder area. In still other cases, the two areas 22 and 24 are of the same temperature, and door 10 divides the two areas for some reason other than temperature, e.g., pest control, isolating a clean room, security, etc. FIG. 1 shows door 10 closed, FIG. 2 shows door 10 partially open, and FIG. 3 shows door 10 fully open.

In the illustrated example, panels 18 and 20 are suspended from panel carriers 26 that can roll, slide, or otherwise travel along an overhead track 28. Track 28 can lie horizontally or lie at an incline. For cold storage applications, panels 18 and 20 preferably comprise a thermal insulating foam core encased in a protective cover; however, other panel structures are well within the scope of the invention.

Door 10 could be manually operated, or a drive unit 30 can be used to open and close door 10. In some cases, drive unit 30 comprises a roller chain 32 supported between a motor-driven sprocket 34 and an idler sprocket 36. One fastener 38 connects a lower portion 40 of chain 32 to panel 18 (via one of the panel carriers 26), and a second fastener 42 connects an upper portion 44 of chain 32 to panel 20. So, the driven rotation of sprocket 34 determines whether panels 18 and 20 move toward each other to close door 10 or move apart to open the door.

To provide sealing along an upper edge 46 and two lateral edges 48 of doorway 12, sealing system 16 includes an inflatable seal 50 (e.g., a pliable tubular seal having any appropriate cross-sectional shape). In some cases, seal 50 comprises two inverted L-shaped sections connected to a common manifold tube 56. To fasten seal 50 to wall 14, a cord 52 or welting of seal 50 can be inserted into a wall-mounted extruded channel 54, as shown in FIG. 4.

Seal 50 has a pliable tubular wall 58 that defines an elongate air passageway 60 that in some cases extends from an air inlet 62 to at least one air outlet 64. This allows a blower 66 to inflate seal 50 by forcing air through passageway 60. The forced air expands tube 50 to fill any gaps between wall 14 and panels 18 and 20. Since tube 50 is inflatable, it can expand to fill wide or irregular gaps, which makes tube 4 particularly useful in retrofitting doors whose existing drive or guidance system is unable to accurately and repeatably position the door panels. To make seal 50 more robust and tolerant of damage, blower 4 may be selected to have a rated discharge volume and pressure that is sufficient to inflate tube 50 even if its tubular wall 58 were punctured or torn, whereby seal 50 can continue functioning even though it may be damaged.

A continuous flow of air through passageway 60 prevents localized cooling of seal 50 by virtue of the fact that the moving air serves to conduct heat throughout the tube. In addition, in the current embodiment, the blower 66 is drawing relatively warmer air for area 24. The heat content of this forced warmer air also helps keep seal 50 relatively warm for the purpose of minimizing or eliminating frost accumulation on the seal. To further inhibit frost from accumulating on the exterior surface of tube 50, in some cases, the material of tubular wall 58 may have some porosity so that relatively warm air within tube 50 actually passes through the tube's wall. In other cases, however, tubular wall 4 is impervious to air.

Keeping seal 50 relatively warm not only inhibits frost from accumulating on seal 50 but also inhibits frost from building up in other areas of door 10. For instance, the doorway edges of many cold storage lockers are often lined with sheet metal cladding 68. Since sheet metal readily conducts heat, the cold storage locker cools cladding 68. This can cause frost to accumulate in area 70, as that area is exposed to the warmer air of area 24. With seal 50 being heated, however, the heat warms cladding 68, which prevents frost from collecting on area 70 of cladding 68.

Frost also tends to collect on an inside surface 72 of panel 18. When door 10 is closed, the colder air in area 22 cools surface 72. Then when the door opens, the relatively cold surface 72 becomes exposed to the warmer air in area 24. The warmer air then condenses on surface 72 and later freezes when the closing of door 10 places the now wet surface 72 back into colder area 22. To avoid this problem, the relatively warm seal 50 wipes the condensation off surface 72, since surface 72 slides across seal 50 whenever the door closes.

In some cases, portions of seal 50 can be lined with thermal insulation 55 (FIG. 4) to help maintain the heat within seal 50, and to thus help minimize or eliminate frost accumulation inside of seal 50. This may be particularly advantageous in applications where seal 50 is mounted in colder area 22. Insulation 55 can be adhesive-backed foam strips that can be applied to the inner surface of tubular wall 58. Other portions of seal 50, that face away from colder area 22, can be left uninsulated to maintain the seal's flexibility. The presence of insulation 55 may also be advantageous in the case of a power loss to the door, as the relative rigidity of insulation 55 may serve itself as a seal when the seal 50 is not inflated, or the rigidity of the insulation 55 may help maintain seal 50 in an expanded condition to allow it to continue providing a sealing function.

To provide sealing along a lower edge 74 of panel 18 and between the leading and abutting edges of panels 18 and 20, sealing system 16 includes another inflatable seal 76. Seals 50 and 76 are similar in that seal 76 also includes a pliable tubular wall 78 that defines an elongate air passageway 80 extending from an air inlet 82 to at least one air outlet 84. Seal 76 comprises two L-shaped sections that two flexible tubes 86 connect to a common manifold tube 88. Flexible tubes 86 allow relative movement between manifold 88, which is stationary, and the portions of seal 76 that are attached to panels 18 and 20, which move between open and closed positions. To force the air through seal 76, blower 66 or a second blower 90 can be connected to manifold tube 88. As in the previous embodiment, the source of forced air for blower 66 may advantageously be from warmer area 24. When expanded by air, tube 76 fills gaps between a floor 92 and panels 18 and 20 and fills gaps between the abutting leading edges of panels 18 and 20 when door 10 is closed. A continuous flow of air through passageway 80 helps keep seal 76 relatively warm to inhibit frost from accumulating in the area of seal 76.

Figure 5:
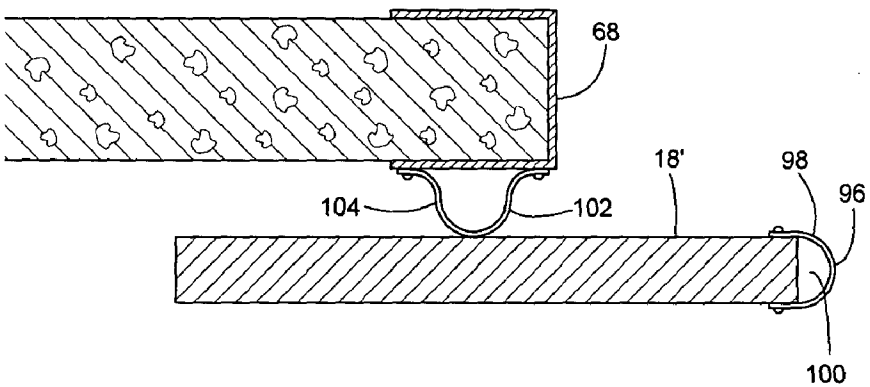
FIG. 5 is a cross-sectional view similar to FIG. 4 but of another embodiment.

An extruded channel 94, similar to channel 54, can attach seal 76 to panel 18. In an alternate embodiment, however, an inflatable tube seal 96 can be created by attaching a flexible sheet of material 98 to a door panel 18', as shown in FIG. 5. An elongate air passageway 100 is then created between panel 18' and material 98. Similarly, another sheet of material 102 can be attached to cladding 68 to create an inflatable tube seal 104.

Figure 6:
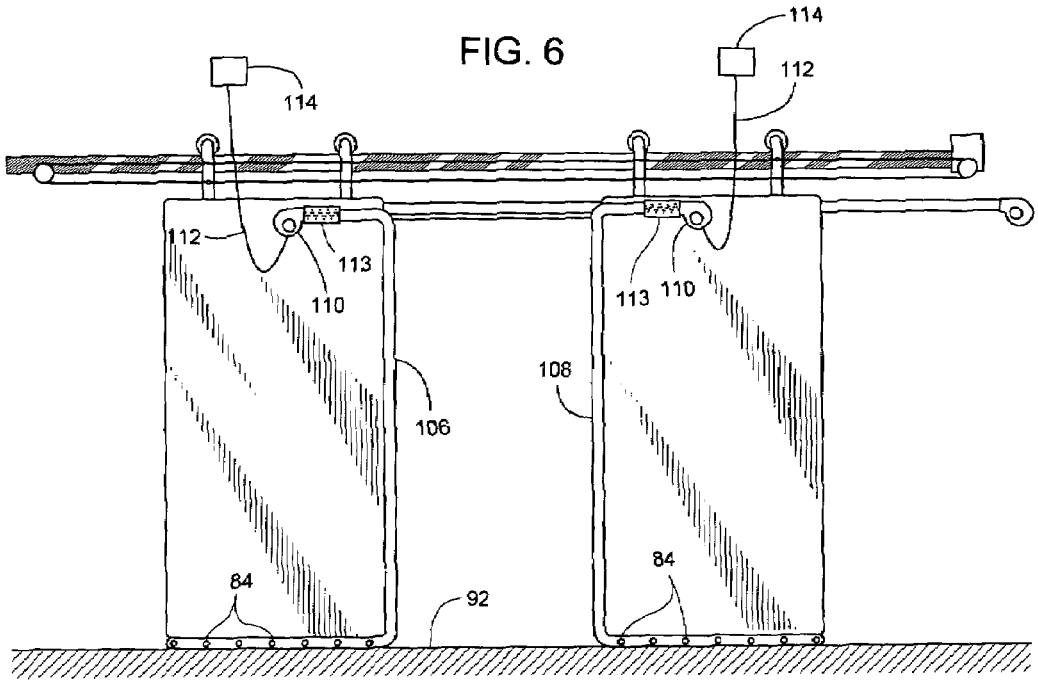
FIG. 6 is a front view similar to FIG. 2 but showing another embodiment.

In another embodiment, shown in FIG. 6, a door 105 includes seals 106 and 108 that each have their own door-mounted blower 110 to eliminate the need for flexible tubes 86. Flexible electrical power cables 112 allow relative movement between blower 110 and its power supply 114.

Rather than relying solely on the heat from the surrounding air in area 24, seals 106 and 108 can be provided with a heater 113 that heats the air or fluid within the seals. Heaters 113 can be any suitable source of heat including, but not limited to, electrical resistance heat. Heaters 113 can be installed at various locations including, but not limited to, within the air passageway downstream of blower 110 (as shown in FIG. 6), at the inlet of blower 110, along the length of seals 106 and 108, adjacent to the exterior surface of seals 106 and 108, etc. Heaters 113 may also be installed in a similar manner to seals 50 and 76 of door 10.

FIG. 6 also shows how multiple outlets 84 can discharge air toward floor 92, which can help keep that area of the floor dry. Seal 76 of door 10 can also have its outlet 84 directed toward floor 92, although the air discharged from a single outlet may not cover as much floor space.

Figure 7:
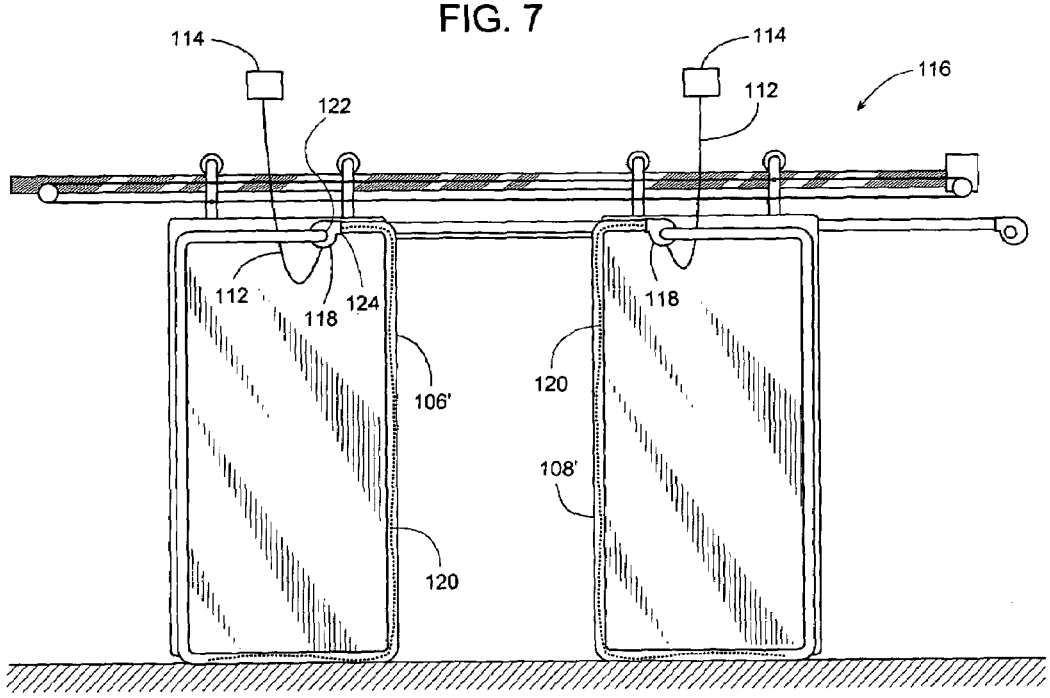
FIG. 7 is a front view of another embodiment.

In another embodiment, shown in FIG. 7, a door 116 includes generally closed seals 106' and 108' where little or no fluid escapes from within the pliable tubular seals. The fluid may be air or some other gas, or the fluid may be water, glycol, or some other liquid. A fluid mover 118 having an inlet 122 and an outlet 124 thus represents an appropriate blower or pump for moving the fluid.

As fluid mover 118 forces fluid to circulate through the elongate passageway (interior) of seals 106' and 108', a heater 120 or a heater such as heater 113 heats the fluid. In this example, heater 120 is an elongate electrical resistive wire, such as conventional heat tape, that can be attached or laid loosely within the interior of seals 106' and 108'. Cable 112, which powers fluid mover 118 and blower 110, can also power heaters 120 and 113.

Fluid mover 118 and blower 110 can be eliminated by installing an elongate wire heater, such as heater 120, within a pliable tubular seal similar to seals 106' and 108'. The seals, however, would be urged to an expanded or inflated state by the seal's own wall stiffness or by hermetically sealing pressurized fluid within the tubular seal.

In cases where a blower is used, repeated starting and stopping of the blower can shorten its life, so the seals in such cases are preferably kept inflated regardless of whether the door is open or closed. Also, a continuous supply of air flowing through the seals helps prevent localized cooling of the seals and/or keeps the seals relatively warm. At the same time, it is considered to be within the scope of the invention to cycle the blower on and off with door activation. That is, the blower could be cycled off when the door moves away from the closed position—thereby minimizing wear on the seals by virtue of the fact that they will be deflated as the door panels move past. The blower could then be reactivated when the door is closed, allowing the seals to inflate and advantageously fill the gaps between the door panels and the surrounding walls or floor.

Although the invention is described with reference to a preferred embodiment, it should be appreciated by those skilled in the art that various modifications are well within the scope of the invention. It should be noted that the term, "door member" refers to any door-related structure including, but not limited to, floor 92; a threshold, a door frame, a lintel, wall 14; cladding 68; door panels 18 or 20; and door seals 50, 76, 96, 104, 106, or 108. The various described seal structures that move with the door panel can also be readily adapted and installed on the stationary or door member portion of the door, and vice versa. It should also be noted that the term "inflatable" when used in reference to a seal means that the seal can be inflated but is not necessarily inflated. For example, a flexible tubular seal may have sufficient rigidity to maintain an open elongate air passageway therethrough even though the air passageway is at a subatmospheric pressure. In such a case, the seal could still be inflated but is not. Instead, the air passageway is connected to the suction side of a blower, which draws air through the air passageway. Finally, while the novel and advantageous seals have been disclosed for use in association with a door, such seals could have broader application for sealing between two or more relatively movable members. In the disclosed embodiments herein, the door member represents one such relatively movable member, and the door panel represents the other. But the seal could potentially be used in a wide variety of other environments and for other purposes besides those disclosed. Therefore, the scope of the invention is to be determined by reference to the claims that follow.

We claim:

1. A door adapted to provide a barrier between a first area of colder air and a second area of warmer air, comprising:

a door member;

a door panel that is movable relative to the door member;

an inflatable seal between the door member and the door panel, wherein the inflatable seal defines an air inlet and an air outlet and includes an inner surface and an outer surface, wherein the inner surface defines an elongate air passageway between the air inlet and the air outlet and the outer surface is in contact with the door member, the door panel, the first area of colder air, and the second area of warmer air, wherein the inflatable seal has a first thickness adjacent the first area of colder air and a second thickness adjacent the second area of warmer air, the first thickness being larger than the second thickness; and a blower connected in fluid communication with the inflatable seal, wherein the blower forces the air in series flow from the area of warmer air, through the air inlet, through the elongate air passageway and in direct contact with the inner surface, through the air outlet, and back to the area of warmer air.

2. The door of claim 1, wherein the door member comprises a second door panel that is movable.

3. The door of claim 1, wherein the door is associated with a wall having a doorway, and the door member is stationary and adjacent to the wall.

4. The door of claim 1, wherein the door is associated with a wall and a floor that define a doorway, and the door member comprises an upwardly facing surface of the floor.

5. The door of claim 4, wherein at least a portion of the air outlet is situated to discharge at least a portion of the air toward the floor, whereby the air discharged from the outlet may help keep the floor dry.

6. The door of claim 1, wherein the air inlet, the air outlet, and the elongate air passageway remain in fluid communication with the area of warmer air when the door is closed.

7. The door of claim 1, wherein the blower continues to force air through the air passageway when the door is open.

8. The door of claim 1, wherein the blower moves with the door panel.

9. The door of claim 1, further comprising a flexible hose that couples the blower to the inflatable seal.

10. The door of claim 1, wherein the door panel translates relative to the door member.

11. The door of claim 1, wherein the door panel includes an upper edge and a substantially vertical edge, and the inflatable seal includes an L-shaped section that is adjacent to the upper edge and the substantially vertical edge.

12. The door of claim 1, wherein the door panel includes a lower edge and a substantially vertical edge, and the inflatable seal includes an L-shaped section that extends along the lower edge and the substantially vertical edge.

13. The door of claim 1, wherein the air at the air inlet is warmer than the air at the air outlet.

14. The door of claim 1, further comprising a heater in heat transfer relationship with the air being forced through the inflatable seal.

15. The door of claim 1, wherein the first thickness is larger than the second thickness because of thermal insulation disposed adjacent the inner surface of the elongate passageway.

16. A door adapted to provide a barrier between a first area of colder air and a second area of warmer air, the door comprising:

a door member;

a door panel that is movable relative to the door member;

a pliable seal between the door member and the door panel, wherein the pliable seal includes an inner surface that defines an elongate passageway and an outer surface in contact with the door member, the door panel, the first area of colder air, and the second area of warmer air, wherein the pliable seal has a first thickness adjacent the first area of colder air and a second thickness adjacent the second area of warmer air, the first thickness being larger than the second thickness;

a fluid disposed inside the pliable seal in contact with the inner surface; and a fluid mover having an inlet and an outlet in fluid communication with the elongate passageway, wherein the fluid mover forces the fluid to circulate in series through the outlet, through the elongate passageway, through the inlet, and back through the fluid mover.

17. The door of claim 16, wherein the fluid mover comprises a pump.

18. The door of claim 16, wherein the fluid mover comprises a blower.

19. The door of claim 16, further comprising a heater in heat transfer relationship with the fluid.

20. The door of claim 16, wherein the door member comprises a second door panel that is movable.

21. The door of claim 16, wherein the door is associated with a wall having a doorway, and the door member is stationary and adjacent to the wall.

22. The door of claim 16, wherein the door is associated with a wall and a floor that define a doorway, and the door member comprises an upwardly facing surface of the floor.

23. The door of claim 16, wherein the first thickness is larger than the second thickness because of thermal insulation disposed on the pliable seal.

24. A door adapted to provide a barrier between a first area of colder air and a second area of warmer air, the door comprising:

a door member;

a door panel that is movable relative to the door member;

a pliable seal between the door member and the door panel, the pliable seal includes an inner surface that defines an elongate passageway and an outer surface in contact with the door member, the door panel, the first area of colder air, and the second area of warmer air, wherein the pliable seal has a first thickness adjacent the first area of colder air and a second thickness adjacent the second area of warmer air, the first thickness being larger than the second thickness;

a fluid disposed inside the pliable seal and in contact with the inner surface; and a heater in heat transfer relationship with the fluid.

25. The door of claim 24, wherein at least a portion of the heater is disposed inside the elongate passageway.

26. The door of claim 24, wherein the fluid is pressurized.

27. The door of claim 24, wherein the door member comprises a second door panel that is movable.

28. The door of claim 24, wherein the door is associated with a wall having a doorway, and the door member is stationary and adjacent to the wall.

29. The door of claim 24, wherein the door is associated with a wall and a floor that define a doorway, and the door member comprises an upwardly facing surface of the floor.

30. The door of claim 24, wherein the first thickness is larger than the second thickness because of thermal insulation disposed adjacent the inner surface of the elongate passageway.

* * * * *

UNITED STATES PATENT AND TRADEMARK OFFICE

CERTIFICATE OF CORRECTION

PATENT NO. : 7,578,097 B2
APPLICATION NO. : 10/667259
DATED : August 25, 2009
INVENTOR(S) : Dondlinger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 110 days.

Signed and Sealed this

Seventh Day of September, 2010

David J. Kappos

David J. Kappos
*Director of the United States Patent and Trademark Office*